United States Patent [19]

Kissinger

[11] 4,111,382

[45] Sep. 5, 1978

[54] APPARATUS FOR COMPENSATING A BALLISTIC MISSILE FOR ATMOSPHERIC PERTURBATIONS

[75] Inventor: Charles W. Kissinger, Silver Spring, Md.

[73] Assignee: The United States of America as represented by the Secretary of the Navy, Washington, D.C.

[21] Appl. No.: 586,010

[22] Filed: Oct. 10, 1966

Related U.S. Application Data

[62] Division of Ser. No. 297,468, Jul. 24, 1963, abandoned.

[51] Int. Cl.[2] ..... F42B 15/12

[52] U.S. Cl. ..... 244/3.1; 244/3.15; 244/3.2

[58] Field of Search ..... 244/3.11, 3.14, 3.15, 244/3.19, 3.20, 3.23

[56] References Cited

U.S. PATENT DOCUMENTS

| | | | |
|---|---|---|---|
| 2,932,467 | 4/1960 | Scorgie | 244/3.15 |
| 3,008,668 | 11/1961 | Darlington | 244/3.11 |
| 3,179,355 | 4/1965 | Pickering et al. | 244/3.14 |
| 3,188,019 | 6/1965 | Boutin | 244/3.2 |
| 3,188,958 | 6/1965 | Burke et al. | 244/3.14 |

*Primary Examiner*—Verlin R. Pendegrass
*Attorney, Agent, or Firm*—R. S. Sciascia; A. L. Branning

[57] ABSTRACT

A ballistic missile guidance apparatus for compensating the trajectory of a ballistic missile just prior to thrust termination by comparing the nominal trajectory with the actual flight parameters encountered during the powered stage of the flight and introducing compensating corrections to provide for an accurate ballistic flight. The comparison is made by storing the nominal kinematic parameters and comparing thereto the actual flight parameters obtained from the inertial guidance system.

4 Claims, 3 Drawing Figures

AUTO PILOT
SEPARATION COMMAND
INERTIAL REFERENCE SYSTEM
INPUTS FROM FIRE CONTROL
BEARING
RANGE R
ε YAW
ε PITCH
ΔR=0
ΔR=K

APPARATUS FOR COMPENSATING A BALLISTIC MISSILE FOR ATMOSPHERIC PERTURBATIONS

The invention described herein may be manufactured and used by or for the Government of the United States of America for governmental purposes without the payment of any royalties thereon or therefor.

BACKGROUND OF THE INVENTION

This application is a divisional of abandoned application Ser. No. 297,468 filed July 24, 1963.

The present invention relates to the guidance of long and short range ballistic missiles and more particularly to flight compensation of these missiles taking into account the effects of atmospheric perturbations thereon.

A ballistic missile as considered herein is defined as a missile which is propelled by a thrust producing device, such as a rocket motor, during the powered stage of the flight and allowed to fly ballistically, that is without power or guidance control, during the remainder of the flight. If the power stage and the ballistic stage encounter more nominal atmospheric conditions, the missile will fly through its predetermined programmed flight and be directed to the desired target impact point. However, should the atmospheric conditions produce substantial perturbations, the missile would fly to an undesired impact point remote from the target and possibly ouside the kill-power range of the missile. Such perturbations include high velocity winds, variation in density, humidity, temperature, and atmospheric pressure.

An object is to provide analog computation apparatus which utilizes data which is available from the inertial guidance system for deriving correction data to control the autopilot in such a manner so as to compensate for atmospheric perturbations.

Other objects, features, and the attendant advantages of this invention will be readily as the same becomes better understood by reference to the following detailed description when considered in connection with the accompanying drawings wherein.

The present invention is shown in block diagram form to aid in the simplicity of presentation of the central elements of the apparatus. A detail explanation of each and every detail such as the amplifiers, integrators, and resolvers of this invention is not considered necessary since it is well known that many electrical and mechanical devices such, for example, as electronic digital computation apparatus or mechanical computation apparatus may be employed in the invention to perform the necessary functions which are set forth and represented in the block diagram form.

Figure 1:
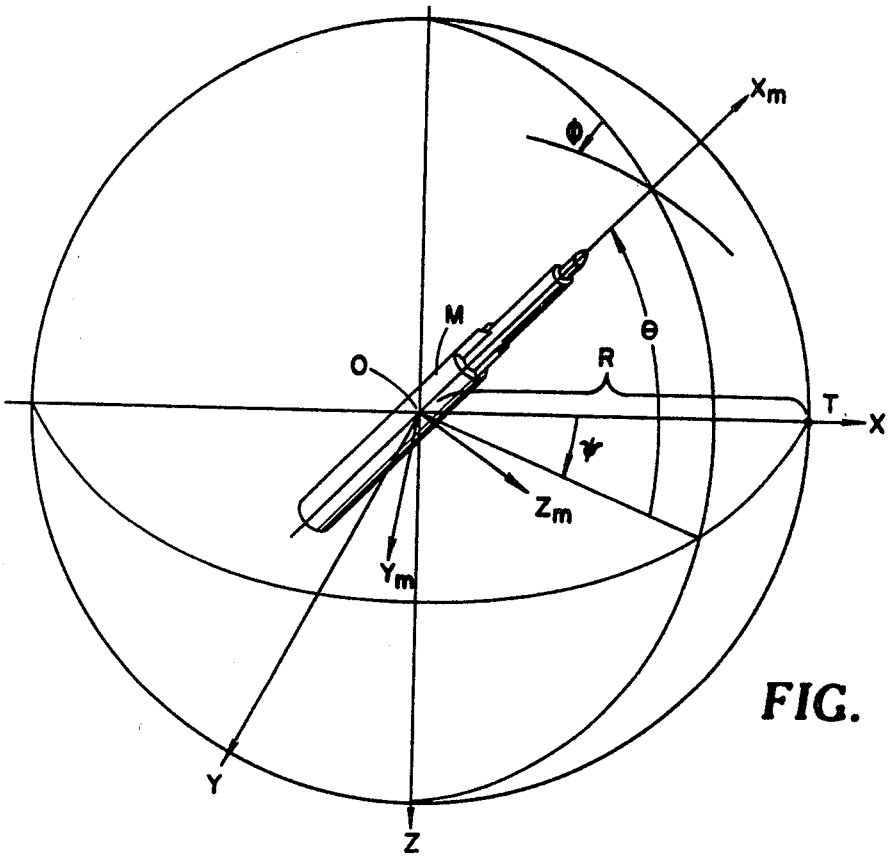
FIG. 1 is a perspective drawing of the terrestial sphere showing the orientation of a missile launched from an origin at the center of the sphere and the coordinates which define the orientation of the missile from the point of launch to the given target.

Referring now to the drawings wherein like reference characters designating like or corresponding parts throughout the several views, there is shown in FIG. 1 a ballistic missile M positioned at the origin O of a terrestial sphere and coordinate system. The missile is assumed to be inertially guided during the powered stage of flight as is well known in the missile guidance art. Kinematic parameters ordinarily available and used for inertial guidance are the $x$, $y$, and $z$ positions, the $\dot{x}$, $\dot{y}$, and $\dot{z}$ velocities, and $\psi$, $\theta$, and $\phi$, the modified Euler angles. The inertial coordinate system of FIG. 1 in which the above parameters determine the orientation of the missile is defined as an orthogonal right-handed system having the origin at the launch point O, the $x$ axis horizontal and positive in the direction extending from the origin O to the target T, and the $z$ axis vertical and positive in the downwardly direction. The Euler angles $\psi$, $\theta$, and $\phi$, are referenced from the right-handed coordinate system as shown in FIG. 1. The missile is assumed to be attitude stabilized during boost, according to the following error signals in azimuth and elevation, respectively;

$$E_{az} = K_1(\psi - \psi_d) + K_2 r \quad (1)$$

$$E_{elev.} = K_3(\theta - \theta_d) + K_4 q \quad (2)$$

where $K_1$, $K_2$, $K_3$, $K_4$ are gain factors $\psi_d$, $\theta_d$ are desired values of $\psi$ and $\theta$, $q$ is the pitch angular rate, and $x$ is the yaw angular rate.

Figure 2:
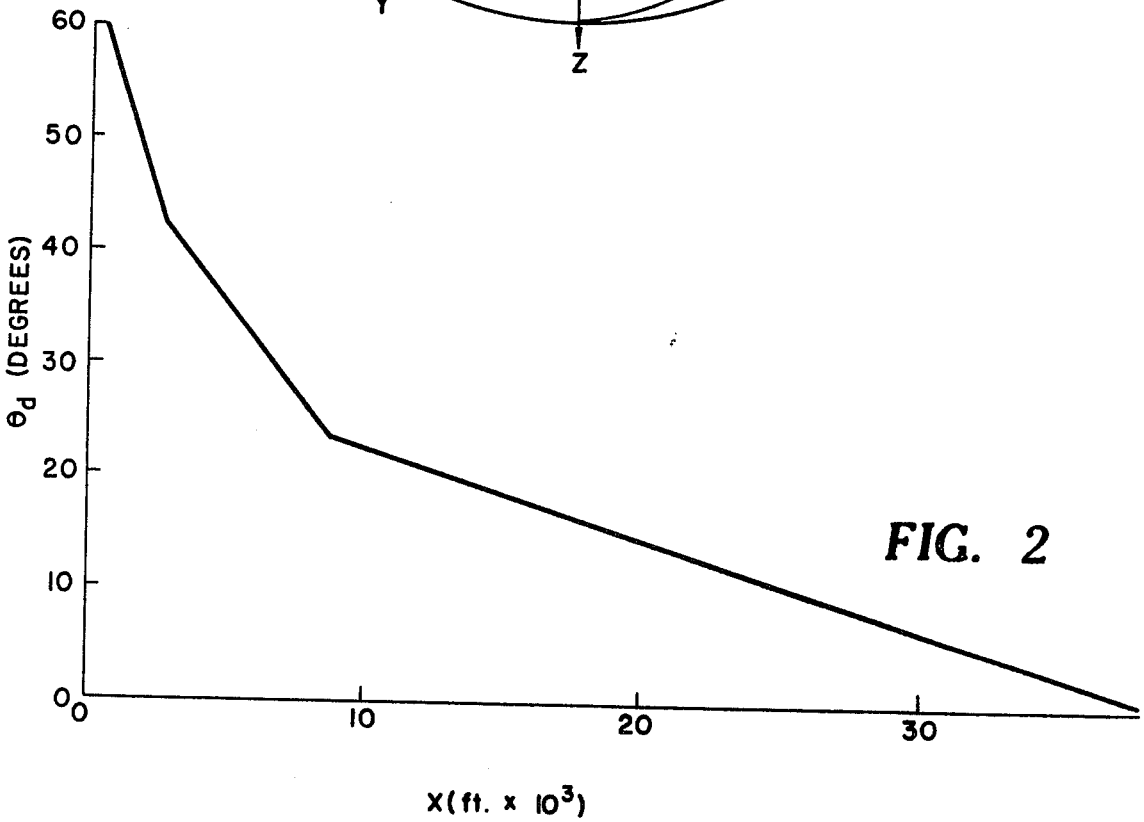
FIG. 2 is a graphical representation of the desired pitch program of the ballistic missile plotted against the distance the missile has traveled toward the target in the range direction.

The azimuth angle $\psi_d$ is held at zero in the missile flight program to thereby define the direction from the origin O to the target T. $\theta_d$ varies throughout the boost phase and defines a precomputed "pitch program", i.e., the manner in which the missile changes pitch attitude during boost. FIG. 2 represents one possible pitch program wherein the desired pitch $\theta_d$ is a function of an independent variable $x$, the distance along the range line R. However, the pitch program can be based on any number of a different independent variables such as time, $\dot{x}$, $z$, $\dot{z}$, etc. The factors governing the choice of the independent variable will be discussed in greater detail hereinafter.

It should be understood that although the discussion which is to follow concerns compensation for headwinds, tail-winds, and cross-wind type perturbations, a like consideration can be made for other types of perturbations such as humidity changes, temperatures changes, and density changes. Considering, for purpose of illustration, those perturbations caused by wind perturbations, it can be seen from FIG. 1 that a wind blowing cross-wise to the direction of the flight of the ballistic missile from origin O to target T will result in the development of both a $y$ and $\dot{y}$ error. The magnitude of the errors can be used as a measure of the cross-wind experienced by the ballistic missile during the powered stage. Corrective action can be taken which will reduce the cross range error at impact. Such corrective action can reduce the impact error substantially since the assumption can reasonably be made that the winds experienced during the descending leg of the trajectory are approximately the same as those experienced on the ascending leg up to the point at which corrective action is taken. Obviously, the shorter the range of the missile, the better this assumption becomes. Also, if cross-wind determination occurs on the ascending leg of the trajectory before the maximum altitude or apogee is reached, the total wind effect will not be detected and corrective action cannot be initiated for those winds which are encountered between the thrust termination and maximum altitude. Therefore, the degree of successful compensation is enhanced when the boost phase or powered stage of flight covers the greatest possible portion of the ascending leg of the trajectory.

If it is desirable to introduce the corrective action to the guidance system just prior to separation of the rocket motor, the amount of change may be expressed as follows:

$$\Delta\psi_d = (K_5(y - y_{nom}) + K_6(\dot{y} - \dot{y}_{nom}))\,K_\psi \quad (3)$$

where $\Delta\psi_d$ is the change in desired heading $K_\psi$, $K_5$, $K_6$ are the gain constants $y - y_{nom}$ is the $y$ error existing at initiation of the corrective action, and is equal to the different between actual displacement, $y$, and the displacement under nominal (no-wind) conditions, $y_{nom}$.

$\dot{y} - \dot{y}_{nom}$ is the $\dot{y}$ error existing at initiation of the corrective action and is equal to the difference between the actual $\dot{y}$ velocity and the velocity, $\dot{y}_{nom}$, under nominal (no-wind) conditions.

By employing this method of action, the cross-wind is sensed up to the time at which $\Delta\psi_d$ is introduced. $\Delta\psi_d$ remains fixed for the remainder of the boost stage. The value of $K_5$ and $K_6$ can be chosen such that effective compensation would be obtained for essentially all of the wind profiles (i.e. the relation between altitude and wind velocity) likely to occur on a statistical basis.

In order to compensate for impact point errors resulting from head or tail winds as distinguished from cross-winds hereinabove considered, the missile is controlled in pitch during the boost phase in accordance with equation (2). The variables $x$, $\dot{x}$, $z$, $\dot{z}$ exhibit a certain relationship dependent upon the magnitude of the head or tail-wind as the missile proceeds through the boost phase. A quite different relationship of these same parameters is encountered when the missile proceeds through the boost phase under nominal or no-wind conditions. In order to detect the effect of such head or tail-winds by sensing changes in these parameters, it is desirable to choose both the pitch program and the functional relation used for detection in such a way that wind perturbations are readily separable from perturbations produced by other causes, e.g. variations in thrust, air density, launch conditions, etc. A choice of the appropriate relations to be used as a basis for the method can best be made by using a computer which can calculate trajectories and the effects of perturbing influences. Such a study has shown that a suitable mechanization is to define $\theta_d$, the desired missile attitude in the vertical plane, as a function of $x$, as shown in FIG. 2. Winds are detected by their perturbation of the nominal relation of $z$ versus $x$. For example, a head or tail-wind causes the altitude $z$ at a given range $x$ to be higher or lower than nominal, respectively. In general this relation may be expressed as follows:

$$\Delta z_x = (\delta z_x/\delta w)\,\Delta w + (\delta z_x/\delta T)\,\Delta T \quad (4)$$

where $\Delta z_x$ is the actual altitude $z$ minus the nominal altitude $z$ at a given $x$ range.

$(\delta z_x/\delta w)$, $(\delta z_x/\delta T)$ $\delta z_x$ are the partial derivaties of $z$ (at a given $x$ range) with respect to wind and thrust, respectively. $\Delta w$ is the number representing an effective wind speed present during the powered stage up to the time when the corrective action is to be taken.

$\Delta T = (T/T_{nom}) - 1$ = variation of thrust from nominal thrust averaged over the boost phase.

Obviously there may be additional terms required on the right-hand side of equation (4) above and where significant they should be included. However, in the illustrative embodiment set forth herein only a select number of terms are included. Equation (4) can be solved for $\Delta w$, the quantity which is essential in determining the desired compensation. Thrust variations which are necessary in the solution of equation (4) may be detected by the direct measurement of rocket motor chamber pressure, or by the effects of thrust variations on trajectory parameters. For example, trajectory calculations show that the function $x_x$ versus $x$ is strongly sensitive to variations in missile thrust, and essentially independent of wind. Therefore, thrust variations may be detected by the following equation:

$$\Delta T = \frac{\Delta\dot{x}_z}{\dfrac{\delta\dot{x}_x}{\delta T}} \quad (5)$$

where $\Delta\dot{x}_x$ is the actual $\dot{x}$ minus the nominal $\dot{x}$ at a given $x$ range.

$\delta\dot{x}x/\delta T$, is the partial derivative of $\dot{x}$ with respect to thrust at a given $x$ range.

By the determination of $\Delta T$ from equation (5) and substitution thereof into equation (4) the measure of the wind experienced during the boost phase, $\Delta w$, is achieved. Having achieved this measure of the wind experienced during the boost phase, it is necessary to adjust the point of thrust termination of the rocket motor and jettison thereof such that the desired impact point will be reached. A cut-off criterion such as the following will provide such a results:

$$R = (\delta R/\delta x)\,\Delta x + (\delta R/\delta x)\,\Delta\dot{x} + (\delta R/\delta z)\,\Delta z + (\delta R/\delta z)\,\Delta\dot{z} + (\delta R/\delta w)\delta w + (\delta R/\delta p)\,\Delta\rho + \ldots \quad (6)$$

where $\Delta R$ is the actual range of the impact or target position minus the desired range.

$\delta R/\delta x$ ... are the partial derivatives of range with respect to the indicated variable.

$\Delta x$ is the actual value of $x$ minus the value of $x$ at thrust termination under nominal conditions.

$\Delta\dot{x}$ is the actual value of $\dot{x}$ much minus the value of $\dot{x}$ at thrust termination under nominal conditions.

$\Delta z$ is the actual value of $z$ minus the value of $z$ at thrust termination under nominal conditions.

$\Delta\dot{z}$ is the actual value of $\dot{z}$ minus the value of $\dot{z}$ at thrust termination under nominal conditions.

$\Delta w$ is the wind as determined from equation (4).

$\Delta\rho$ is the variation in the air density which is equal to $(\rho/\rho nom) - 1$ averaged over the boost phase.

The mechanization and solution of equation (6) as practiced by the present invention is computed by the circuitry to be set forth hereinafter in the balistic missile, and thrust is terminated when R goes to zero. The partial derivatives as well as the nominal values of $x$, $\dot{x}$, $z$, and $\dot{z}$ must be inserted into the missile prior to launch. These quantities can be obtained from trajectory calculations. $\Delta w$ is determined during the flight from equation (4) and the remaining variable, density, can be estimated on the basis of location and season, or determined from atmospheric pressure and temperature. Since temperature variations are more influential than pressure variations upon the density, a temperature measurement on the missile would permit a sufficiently accurate determination of density. Should the required degree of accuracy of wind compensation permit, an average temperature based on location and season could be inserted by fire control, thereby obviating the need for the temperature measurement device.

Figure 3:
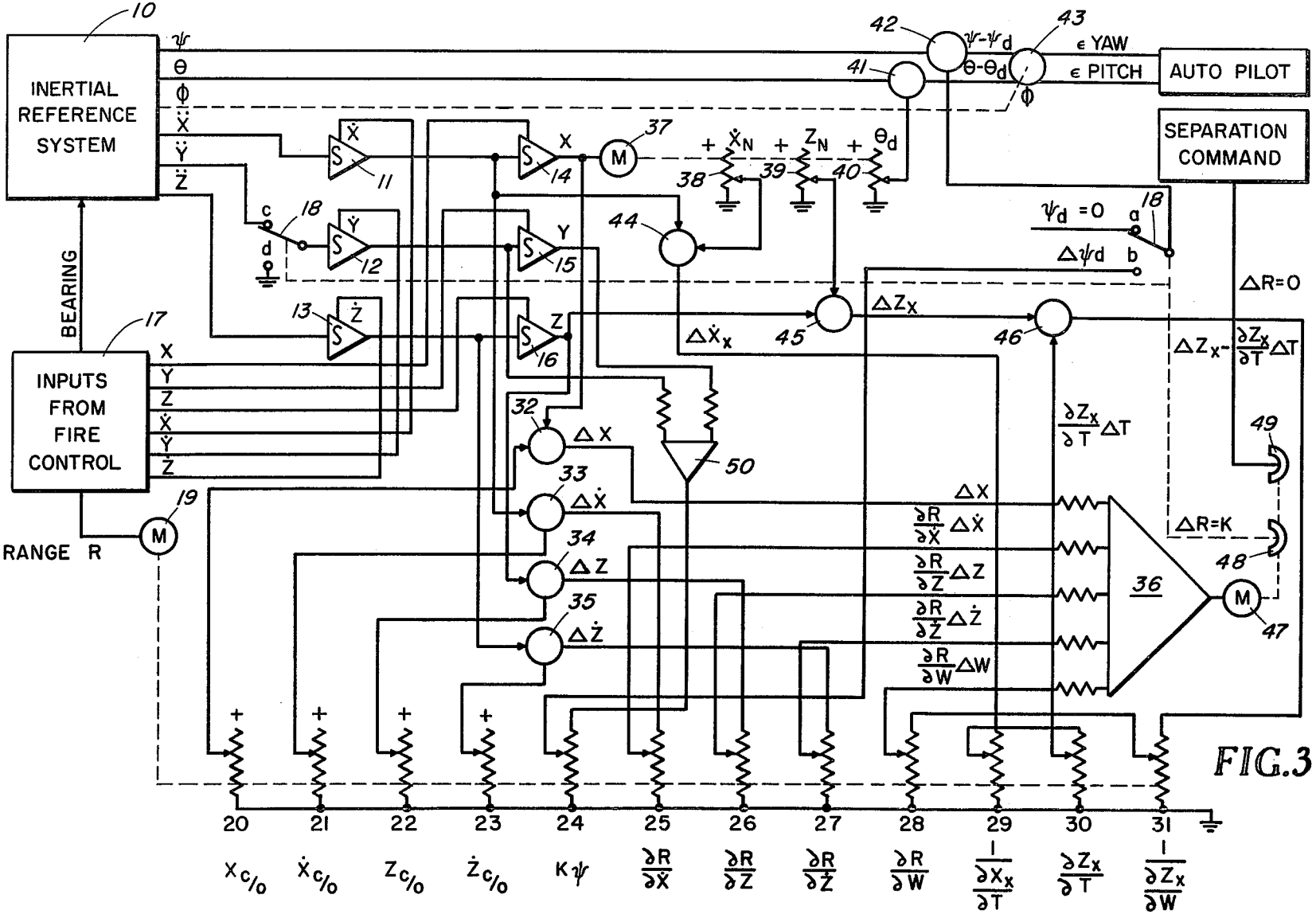
FIG. 3 is a block diagram representation of the analog computation apparatus of the present invention.

A schematic block diagram of one possible mechanization of the invention described hereinabove is shown in FIG. 3. The computing components used to perform the functions of integration, multiplication, summation, etc., are shown as analog type devices and are well known in the field of analog computation. The illustrative embodiment shown in FIG. 3 is not necessarily optimum with regard to the number of elements required. Any details of the mechanization and instrumentation would obviously vary with the particular application.

The inertial reference system 10 incorporates accelerometers with a stable platform and a system of freegyros as is well known in the inertial guidance systems art. It is assumed that the output, information for system 10 includes the angles $\psi$, $\theta$, and $\phi$ and accelerations $\ddot{x}$, $\ddot{y}$, and $\ddot{z}$. The accelerations $\ddot{x}$, $\ddot{y}$ and $\ddot{z}$ are integrated once by integrators 11, 12 and 13, respectively. The output signals from the integrators 11, 12 and 13 provide the velocities $\dot{x}$, $\dot{y}$ and $\dot{z}$, respectively and a second integration by integrators 14, 15 and 16 yield the displacements $x$, $y$, and $z$, respectively.

The inputs from fire control are derived at 17 and provide the target range and bearing as well as the initial conditions for integrators 11 through 16. Target bearing is used to align the inertial reference system in azimuth, so that the azimuth angle $\psi$ is equal to zero along the range line from the origin O to target T. Thus, the desired azimuth angle $\psi_d$ is maintained at zero during that portion of the boost phase prior to the initiation of the azimuth corrective action. This is indicated at contact a of switch 18. The voltage from input 17 representing target range R, drives a servo motor 19 which rotates an output shaft an amount proportional to the target range. This shaft drives the potentiometers 20 through 31. Each of the individual potentiometers of this potentiometer bank provides a variable voltage which is a non-linear function of desired range. The output voltages of potentiometers 20, 21, 22 and 23 represent the nominal or no-wind values of $x$, $x$, $z$, and $z$, respectively at the programmed thrust termination point. This is denoted in FIG. 3 by the subscript *c/o*. The differences between these nominal cut-off voltages and the instantaneous voltages representing the instantaneous values of $x$, $\dot{x}$, $z$ and $\dot{z}$, are obtained at summing points 32, 33, 34, and 35, respectively. The output voltages of the summing devices represent $\Delta x$, $\Delta\dot{x}$, $\Delta z$, and $\Delta\dot{z}$ which are used in the solution of equation (6).

To obtain the first four terms of equation (6), the terms must be multiplied by their associated partial derivatives. With the exception of $\delta R/\delta x$, which is always unity by definition in the coordinate system under consideration, these partial derivates vary as the ballistic missile progresses through a normal boost phase. As a first order of approximation, it is sufficiently accurate to use that value of the partial derivative which applies at the point of a normal boost phase corresponding to thrust termination for the desired range. These values for the derivatives $\delta R/\delta\dot{x}$, $\delta R/\delta\dot{z}$, and $\delta R/\delta\dot{z}$ as functions of the desired range are determined by the tap settings on potentiometers 25, 26 and 27 respectively. It should be understood for the purpose of illustration that these partial derivatives are less than unity and are shown as being generated by potentiometers. However, where it is necessary to provide voltages which represent partial derivative values greater than unity, an amplifier can be inserted at a convenient point in the signal path to provide the necessary gain. This insertion of a conventional amplifier is necessary since a potentiometer multiplies a voltage only by a factor less than unity. The first four terms of equation (6) thus obtained are fed to summing amplifier 36. The term $(\delta R/\delta\rho)\Delta\rho$ is not shown in the circuit of FIG. 3, it being assumed that this term is computed in fire control and entered as a correction to the desired range, R. Therefore, for the solution of equation (6) it remains only to compute the term $(\delta R/\delta w)\ \Delta w$.

The manner in which this is accomplished is set forth directly hereinafter.

The output of $x$ integrator 14 in addition to being fed to summing point 32 drives a servo motor 37 which in turn drives a mechanical shaft through an angular rotation proportional to the value of $x$. Non-linear potentiometers 38, 39 and 40 are constructed so as to generate the desired variables as functions of $x$. These potentiometers are mechanically linked to the shaft being rotated by servomotor 37. The output of potentiometer 38 is the nominal value of $\dot{x}$ as a function of $x$ as is required for the solution of equation (5). The output of potentiometer 39 is the nominal value of $z$ as a function of x as is required for the solution of equation (4). The potentiometer 40 generates the desired elevation attitude $\theta_d$ which is fed to summing point 41 and there compared with the actual elevation angle $\theta$. The output of summing point 41 is the elevation error signal which along with the azimuth error signal derived at summing point 42 is resolved through the roll angle $\phi$ by a conventional resolver 43. The output signals of resolver 43 are values, in the missile coordinate system, for the pitch and yaw error signals which are used to control the autopilot and thereby the flight of the missile.

The $\Delta\dot{x}_x$ of equation (5) is obtained by taking the difference between the actual $\dot{x}$ appearing as the output of integrator 11 and the value of $\dot{x}$ appearing as the output of nominal $\dot{x}$ potentiometer 38. This is accomplished by the summing amplifier 44. The term $\Delta\dot{x}_x$ thus obtained is divided by $\delta\dot{x}_x/\delta_T T$ by means of potentiometer 29 to yield the quantity T of equation (5). This quantity $\Delta T$ in turn is multiplied by $\delta z_x/\delta T$ at potentiometer 30 to yield the term $(\delta z_x/\delta T)\ \Delta T$ of equation (4). It should be understood that separate potentiometers 29 and 30 are shown for the purpose of clarity and that these two potentiometers could be combined into one potentiometer providing the desired multiplication and division.

The quantity $\Delta z_x$ is obtained by taking the output $z$ of integrator 16 and feeding it to summing point 45 where it is compared to $z_n$, the nominal value of $z$ derived from potentiometer 39. The output $(\delta z_x/\delta T)\Delta T$ of potentiometer 30 is subtracted from $\Delta z_x$ at summing point 46. The voltage output of summing point 46 is divided by $\delta z_x/\delta w$ at potentiometer 31, yielding the desired unknown quantity $\Delta w$ which in turn is multiplied by $\delta R/\delta w$ at potentiometer 28. The resultant output voltage of potentiometer 28 has the value $(R/w)\ w$ which is the remaining term of equation (6) to be determined. This term $(\delta R/\delta w)\Delta w$ is summed with the other terms of equation (6) by means of summing amplifier 36 to provide the change in range $\Delta R$ of equation (6).

The output voltage of amplifier 36 drives the servomotor 47 which in turn drives a mechanical shaft to thereby control the operation of the actuators 48 and 49. Actuator 48 is set to operate when $\Delta R$ is some value other than zero occurring prior to thrust termination. Through the operation of actuator 48 the contacts of switch 18 are switched from the "*a*" position to the "*b*"

position. Switch 18 being a gang switch, the positions "*c*" and "*d*" are also controlled by switch 18. Operation of actuator 48 to change the positions of the ganged switch, initiates the azimuth maneuver which corrects for cross range error due to cross-winds as set forth hereinabove. Prior to the time of operation of actuator 48, contact 18a is closed sending the value $\psi_d = 0$ to summing point 42. However, after operation of switch 48, contact 18b is closed, sending the value $\Delta\psi_d$ to summing point 42.

This value $\Delta\psi_d$ is obtained by summing $K_5 y$ and $K_6 \dot{y}$ at summing amplifier 50 and multiplying this sum by $K_{104}$ at potentiometer 24. Actuator 48 also serves the dual purpose of removing the $\dot{y}$ input from integrator 12 by breaking contact 18c and making contact 18d. This is necessary to insure that $\Delta\psi_d$ remains constant throughout the azimuth maneuver.

When $\Delta R = 0$, actuator 49 operates thereby initiating thrust termination by providing a separation command signal. Motor separation and thrust termination occurs when equation (6) is satisfied by the left-hand side, $\Delta R$, being equal to zero. Ballistic flight then begins with the assurance that compensation for the atmospheric wind perturbations has been carried out.

This it may be seen by the use of purely inertial information which is already present during the guided boost phase of a ballistic missile it is possible to detect and measure the effects of atmospheric perturbations on the flight of a ballistic missile during the powered stage. The information thus gained is used to compensate for these perturbations by comparing certain known relations of kinematic parameters for nominal atmospheric conditions to the relations of these same parameters under actual flight conditions. Availability of these actual flight parameters in the inertial guidance system is thereby utilized to avoid complex instrumentation which is necessary where compensation of atmospheric perturbations depends upon direct measurements thereof.

Obviously many modifications and variations of the present invention may be made possible in the light of the above teachings. It is therefore to be understood, that within the scope of the appended claims, the invention may be practiced otherwise than as specifically described.

What is claimed is:

1. In an inertial guidance system for a ballistic missile, an analogue computer comprising register means having preset voltages representing nominal azimuth and altitude position and velocity values of a programmed thrust termination point, means producing voltages representing instantaneous values of azimuth and altitude positions and azimuth and altitude velocities of said missiles, means subtracting the instantaneous position and velocity voltages from the nominal position and velocity voltages respectively providing difference voltage output signals therefrom, means multiplying each of said difference voltage signals by their respective derivates of range providing altitude and azimuth deviation voltage output signals, means computing a deviation voltage output signal representing head and tail wind perturbations on range, and summing means adding said deviation voltages providing bearing correction and thrust cut off output control signals.

2. The apparatus of claim 1 further comprising inertial guidance means providing instantaneous range and bearing kinematic parameter voltage signals to said analog computer, error signals means for supplying yaw and pitch information for the computation of a corrected missile trajectory program, and thrust termination means responsive to said cut-off control signal after the missile trajectory has been corrected.

3. The apparatus of claim 1, wherein said register means and said multiplying means are potentiometers, and said instantaneous position and velocity voltage producing means include first and second integrators.

4. The apparatus of claim 1 wherein said computing means comprises, means for producing a voltage signal representing the quantity $\Delta Z_x - (\delta Z_x/\delta T)\Delta T$ where $Z_x$ is the altitude at a given $x$ range and T is missile thrust, means for dividing said quantity by $\delta Z_x/\delta w$ where W is the wind speed, and providing a voltage output representing the effective wind speed present during the powered stage up to the time when corrective action is to be taken, and means for multiplying said wind speed voltage by a preset derivative of range with respect to wind speed.

* * * * *